US005122386A

United States Patent [19]

Yoshida

[11] Patent Number: 5,122,386

[45] Date of Patent: Jun. 16, 1992

[54] DOUBLE SIDE COATING METHOD

[75] Inventor: Toru Yoshida, Kanagawa, Japan

[73] Assignee: Fuji Photo Film Co., Ltd., Kanagawa, Japan

[21] Appl. No.: 515,137

[22] Filed: Apr. 26, 1990

[30] Foreign Application Priority Data

May 1, 1989 [JP] Japan ..... 1-109135

[51] Int. Cl.[5] ..... B05D 3/06; B05D 5/00

[52] U.S. Cl. ..... 427/13; 427/40; 427/41; 427/44; 427/209

[58] Field of Search ..... 427/41, 44, 209, 13, 427/40; 118/621

[56] References Cited

U.S. PATENT DOCUMENTS 4,455,327 6/1984 Yoshida et al. ..... 427/131
4,457,256 7/1984 Kisleu et al. ..... 118/621
4,837,045 6/1989 Nakajima ..... 427/13

*Primary Examiner*—Evan Lawrence
*Attorney, Agent, or Firm*—Sughrue, Mion, Zinn, Macpeak & Seas

[57] ABSTRACT

A double side coating method in which immediately after a first coating is carried out for the first side of a web, the first side of the web is supported in a non-contact manner, and a second coating is carried out for the second side of the web. Immediately before the second coating is carried out, the second side of the web is charged in unipolarity by corona discharges induced by a high voltage generating unit with an electrode.

4 Claims, 1 Drawing Sheet

DOUBLE SIDE COATING METHOD

BACKGROUND OF THE INVENTION

This invention relates to a method of applying a coating solution such as photographic emulsion or magnetic agent to both sides of an elongated flexible support (hereinafter referred to as "a web") in order to manufacture photographic photo-sensitive materials such as photographic films and photographic print paper, photo-engraving materials, magnetic recording materials such as magnetic sound recording tapes and pressure-sensitive copying sheets, heat-sensitive recording sheets, or the like.

In a conventional method of successively coating both sides of a web is as follows: After one of the two sides of a web is coated, the coated side is supported in a non-contact manner, and then the other side is coated as shown in, for example, U.S. Pat. No. 4,455,327.

However, the conventional method suffers from a difficulty that, as the coating speed increases, the air, being entrained on the surface of the web running at a high speed, remains between the coating solution and the web, thus making the coated surface defective.

One of methods for overcoming this difficulty is as follows: Namely the affinity of a coating solution to a web is increased. More specifically, for instance the density of the coating solution is decreased (in the case of a coating solution containing gelatin, the density of gelatin is decreased) so that the viscosity of the coating solution on the web is decreased. However, the method is still disadvantageous in that the drying load is increased, so that the employment of the method is limited.

SUMMARY OF THE INVENTION

Accordingly, an object of this invention is to overcome the above-described difficulties inherent in a conventional double side coating method. Another object of the invention is to provide a double side coating system in which a high speed coating operation can be satisfactorily achieved without changing the maintained recipe of solution.

The foregoing and other objects of the invention have been achieved by the provision of a double side coating method for coating a web having a first side and a second side opposite to said first side with solution, comprising the steps of: coating said first side of the web with solution; coating said second side of the web with solution while supporting said first side in a non-contact manner after said coating for said first side; and effecting unipolarity charge to said second side by corona discharges induced by a high voltage electrode immediately before said coating for said second side.

According to another aspect of the invention, a double side coating apparatus for coating, with solution, a web having first side and a second side opposite to said first side, comprising: a first coating means for coating said first side with solution, said first coating means having a back-up roller for conveying said web; a charging means located downstream of said first coating means for effecting unipolarity charge to the second side of the web by corona discharges, said charging means having a high voltage generating unit with an electrode for inducing said corona discharges; a second coating means located downstream of said charging means for coating the second side with solution; and, an air-floating drum means for supporting said first side of said web in a non-contact fashion when said web is delivered through said charging means.

According to the method and apparatus of the invention, immediately before the coating for the second side, the second side of the web is charged in unipolarity by corona discharge. In the conventional method, usually for corona discharges, it is necessary to provide a grounded roller to support the first side of the web. In the invention, it is not permitted to use such an grounded roller, because it would damage the first side of the web which has been coated. However, through the first side of the web thus coated being electrically conductive, the second side of the web can be charged without a grounded roller. The electrical conductivity of a coating solution applied to the first side of the web is preferably 200 $\mu\Omega^{-1}$/cm or higher, more preferably 500 $\mu\Omega^{-1}$/cm or higher, with the coating solution being kept at a temperature of 40° C.

The surface of the web is preferably charged in the range of 10 V/cm to 5000 V/cm, more preferably 100 V/cm to 3000 V/cm, when measured with a surface electrometer. The surface should not be charged excessively high, in order to prevent the abnormal discharge of the electrode.

In the invention, immediately before the second coating, the second side of the web is charged in unipolarity. As a result, the affinity and adhesion of the coating solution to the web are improved, and accordingly a high speed coating operation can be achieved with high stability.

In the invention, the electrode for corona discharge may be made of metal or carbon fiber, and it may be in the form of a thin wire, brush, knife edge or flat plate.

In the invention, the web includes those which are made of paper, plastic film, resin-coated paper, synthetic paper, or the like. The plastic film may be of polyolefin such as polyethylene and polypropylene, vinyl copolymer such as polyvinyl acetate, polyvinyl chloride and polystyrene, polyamide such as 6,6-nylon, 6-nylon, polyester such as polyethylene terephthalate, polyethylene-2, 6-napthalate, and cellulose acetate such as polycarbonate, cellulose triacetate and cellulose diacetate. The resin for the resin coated paper may typically be polyolefin such as for instance polyethylene. Some of the webs formed of resin coated paper are laminated on one side or both sides; however, it should be noted that the webs used in the invention are not limited thereto or thereby.

In the invention, the term "coating solution" is intended to mean a variety of coating solutions different in composition separately according to their applications; that is, it includes for instance, coating solutions for forming a photo-sensitive emulsion layer, subbing layer, protective layer, back layer in a photographic photo-sensitive material, coating solutions for forming a magnetic layer, subbing layer, lubricant layer, protective layer and back layer in a magnetic recording medium, and other coating solutions for forming an adhesive layer, coloring layer and rust preventive layer. Those coating solutions contain water-soluble binder or organic binder.

The above-described coating solutions can be applied to the webs by a slide coating method, roller bead coating method, spray coating method, extrusion coating method, and curtain coating method for instance.

BRIEF DESCRIPTION OF THE DRAWINGS

In the accompanying drawings.

DESCRIPTION OF THE PREFERRED EMBODIMENTS

Figure 1:
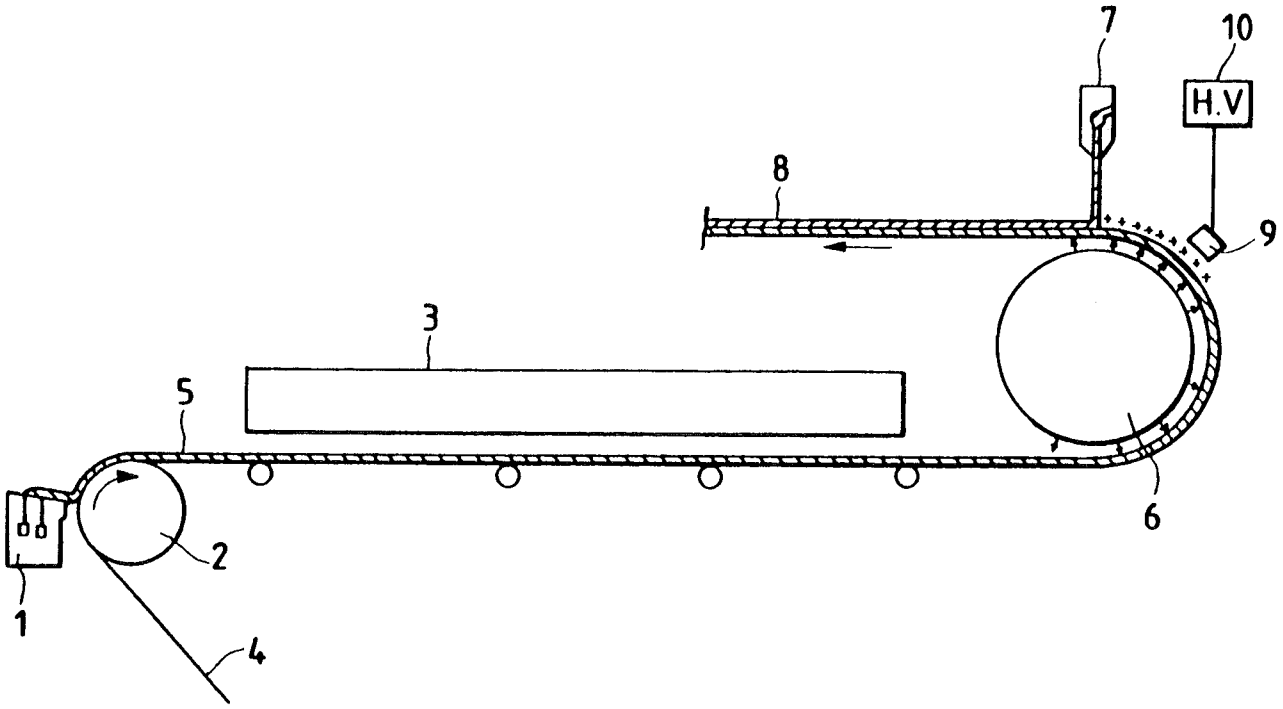
FIG. 1 is a diagrammatic side view showing a double side coating system according to this invention.

One embodiment of this invention will be described with reference to the single drawing.

FIG. 1 is a diagrammatic side view for illustrating a double side coating system according to the invention.

At the first coating station, a coating solution 5 consisting of an emulsion layer and a protective layer as print sensitive material is applied by a first coating device 1 to one side of a web 4 laid over a backup roll 2. The coating solution thus applied is allowed to gel, while being cooled down in a chilling zone 3. The web 4 thus processed is supported over a floating drum 6, in a non-contact manner, by the pressure of the air blown from the drum 6, and charged in unipolarity by corona discharges induced by a high voltage generating unit 10 with an electrode 9 immediately before the second coating is carried out for the second side of the web. In the second coating, a back layer 8 for preventing halation is formed on the web by a second coating device 7. The electrical conductivities of the emulsion layer and the protective layer are 1700 $\mu\Omega^{-1}$/cm and 500 $\mu\Omega-1$/cm, respectively, with the coating solution being kept at a temperature of 40° C.

In the case where the second coating solution of 8% gelatin density forming the back layer 8 for preventing halation is used to perform the second coating according to a so-called curtain coating method, heretofore when the coating speed is increased to 180 m/min or higher, especially to 200 m/min or higher, the air is entrained on the surface of the web, thus forming a number of defects on the coated surface of the web. On the other hand, in the invention, where the charge on the surface of the web is measured to 1000 V/cm with a potentiometer, the difficulty that the air is entrained on the surface of the web is not caused until the coating speed is increased to 330 m/min. In addition, the web is charged uniformly. Thus, the coated surface is satisfactory in quality.

The same effects are obtained with the floating drum 6 not grounded which is adapted to support the first coating surface in a non-contact manner.

As was described above, in the invention, the first coated surface which is electrically conductive is supported in a noncontact manner, and the other surface is charged in unipolarity by corona discharges induced by the high voltage generating unit with the electrode immediately before the second coating operation is carried out. Hence, in the second coating operation, the coating solution applied is stable in bead condition, and the difficulty is eliminated that, during the high speed coating operation, air is entrained on the surface of the wed, or that coated layer is disturbed when the spliced prtion of the web passes. Thus, according to the invention, the high speed coating operation is improved in productivity, with the resultant products being high in quality.

What is claimed is:

1. A double side coating method for coating a web having a first side and a second side opposite to said first side with a first and a second solution, respectively, comprising the steps of:

coating said first side of the web with said first solution, said first solution being electronically conductive;

cooling said first side of said web after said first side is coated with said first solution;

coating said second side of the web with said second solution while supporting said first side in a non-contact manner after said coating of said first side; and effecting unipolarity charge to said second side by corona discharges induced by a high voltage electrode immediately before said coating of said second side.

2. The method according to claim 1 in which the electrical conductivity of said first solution is at least 200 $\mu\Omega^{-1}$/cm.

3. A double side coating method for coating a web having a first side and a second side opposite to said first side with a first and second solution, respectively, comprising the steps of:

coating said first side of the web with said first solution, said first solution being electrically conductive;

coating said second side of the web with said second solution while supporting said first side in a non-contact manner after said coating of said first side; and effecting unipolarity charge to said second side by corona discharges induced by a high voltage electrode immediately before said coating of said second side.

4. The method according to claim 3 in which the electrical conductivity of said first solution is at least 200 $\mu\Omega^{-1}$/cm.

* * * * *